US009624012B2

(12) United States Patent
Laib et al.

(10) Patent No.: US 9,624,012 B2
(45) Date of Patent: Apr. 18, 2017

(54) FITMENT FOR A CONTAINER

(71) Applicant: Owens-Brockway Glass Container Inc., Perrysburg, OH (US)

(72) Inventors: Douglas Laib, Perrysburg, OH (US); Jessica Rose Bryant, Toledo, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 14/683,529

(22) Filed: Apr. 10, 2015

(65) Prior Publication Data

US 2015/0210448 A1 Jul. 30, 2015

Related U.S. Application Data

(62) Division of application No. 13/621,621, filed on Sep. 17, 2012, now Pat. No. 9,027,793.

(51) Int. Cl.

| | |
|---|---|
| ***B65D 47/02*** | (2006.01) |
| ***B65D 49/04*** | (2006.01) |
| ***B65D 47/40*** | (2006.01) |
| ***B65D 49/00*** | (2006.01) |
| ***B65D 49/10*** | (2006.01) |
| ***B65D 25/20*** | (2006.01) |
| ***B67D 3/00*** | (2006.01) |

(52) U.S. Cl.

CPC ..... *B65D 49/04* (2013.01); *B65D 25/205* (2013.01); *B65D 47/40* (2013.01); *B65D 49/00* (2013.01); *B65D 49/10* (2013.01); *B67D 3/00* (2013.01); *Y10T 29/49865* (2015.01)

(58) Field of Classification Search

CPC ..... B65D 49/00; B65D 49/04; B65D 49/06; B65D 49/08; B65D 49/10; B65D 49/12; B65D 47/40; B67D 3/00; Y10T 29/49685

USPC ..... 222/147, 153.09, 153.1, 321.1; 215/14–30, 232, 250, 258, 305

See application file for complete search history.

(56) References Cited

U.S. PATENT DOCUMENTS

| | | | | | |
|---|---|---|---|---|---|
| 772,269 | A | | 10/1904 | Bailey | |
| 989,964 | A | | 4/1911 | Hand | |
| 1,063,698 | A | | 6/1913 | Kovac | |
| 1,072,583 | A | | 9/1913 | Dignon | |
| 1,153,519 | A | * | 9/1915 | Robbins | B65D 49/04 215/26 |
| 1,154,638 | A | | 9/1915 | Jackson | |
| 1,161,328 | A | * | 11/1915 | Pavesi | B65D 49/04 215/26 |
| 1,251,736 | A | | 1/1918 | Bart | |
| 1,326,974 | A | * | 1/1920 | Schmidt | B65D 49/00 116/206 |
| 1,425,957 | A | | 8/1922 | Freid | |

(Continued)

FOREIGN PATENT DOCUMENTS

| | | |
|---|---|---|
| GB | 970678 | 9/1964 |
| GB | 2418910 A | 4/2006 |
| WO | 9212908 | 8/1992 |

OTHER PUBLICATIONS

PCT International Search Report and Written Opinion, Int. Serial No. PCT/US2013/057233, Int. Filing Date: Aug. 29, 2013, Applicant: Owens-Brockway Glass Container Inc., Mail Date: Nov. 8, 2013.

*Primary Examiner* — Lien Ngo

(57) ABSTRACT

A product includes a container including a neck, and a fitment having a portion coupled to the neck of the container via an interference fit.

13 Claims, 3 Drawing Sheets

(56) References Cited

U.S. PATENT DOCUMENTS

| | | | | | |
|---|---|---|---|---|---|
| 1,994,625 | A | * | 3/1935 | Tivoli | B65D 49/06 215/25 |
| 2,025,498 | A | * | 12/1935 | Desmond | B65D 49/04 215/21 |
| 2,079,775 | A | | 5/1937 | Simons | |
| 2,122,595 | A | | 7/1938 | Stonebraker | |
| 2,653,726 | A | * | 9/1953 | Bernal | B65D 49/06 215/22 |
| 2,953,270 | A | | 9/1960 | Jimenez | |
| 3,073,470 | A | * | 1/1963 | Greene | B65D 49/06 215/22 |
| 3,399,811 | A | | 9/1968 | Miller | |
| 3,933,284 | A | | 1/1976 | Guala | |
| 4,258,854 | A | | 3/1981 | Wright | |
| 4,261,484 | A | | 4/1981 | DaCosta et al. | |
| 4,382,520 | A | * | 5/1983 | Aleff | B65D 49/06 215/21 |
| 4,660,744 | A | | 4/1987 | Csaszar | |
| 5,315,811 | A | | 5/1994 | Biesecker et al. | |
| 5,480,915 | A | * | 1/1996 | Burns | B65D 39/00 215/355 |
| 2010/0059472 | A1 | * | 3/2010 | Eagleton | B65D 39/0058 215/230 |

* cited by examiner

FITMENT FOR A CONTAINER

The present disclosure is directed to containers and, more particularly, to container fitments.

BACKGROUND AND SUMMARY OF THE DISCLOSURE

A container for carrying a liquid product can include a fitment that renders the container non-refillable so as to impede or prevent efforts to refill the container with inferior products. U.S. Pat. No. 3,399,811 illustrates a container of this type.

A general object of the present disclosure, in accordance with one aspect of the disclosure, is to provide a container including a fitment that is non-removably secured to the container, and/or including a non-refillable fitment that evidences efforts to tamper with the package via breakage of the container.

The present disclosure embodies a number of aspects that can be implemented separately from or in combination with each other.

A product in accordance with one aspect of the disclosure includes a container including a neck, and a fitment coupled to the neck of the container via an interference fit.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
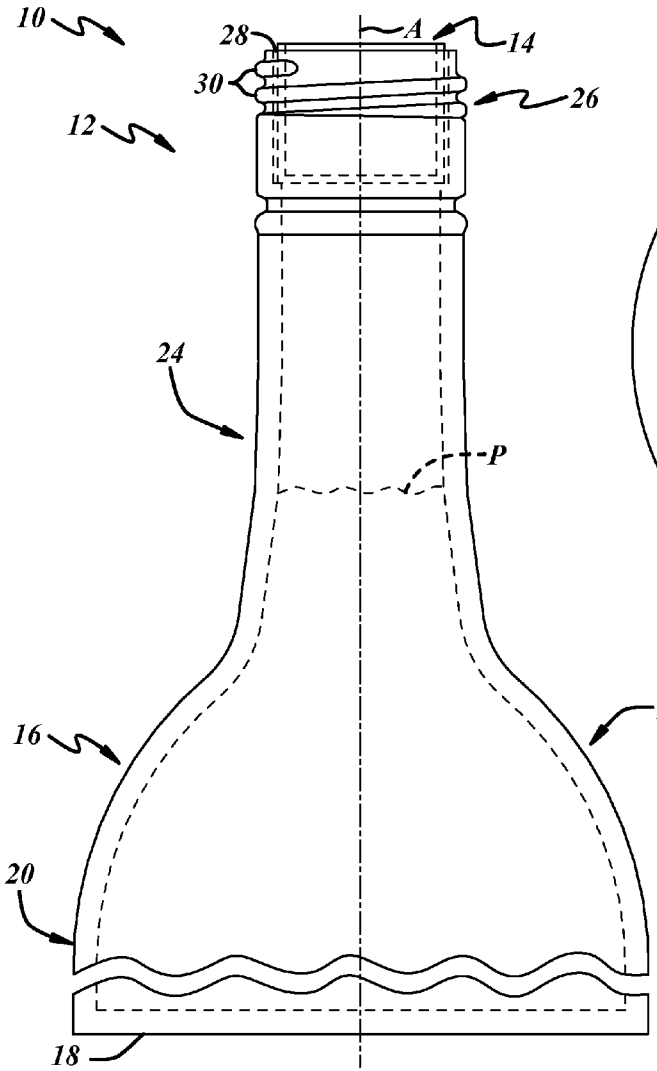
FIG. 1 is a fragmentary elevational view of a product in accordance with an illustrative embodiment of the present disclosure and including a container and a fitment coupled to the container to render the container non-refillable.

FIG. 1 illustrates a product 10 in accordance with an illustrative embodiment of the disclosure as including a container 12 to hold a liquid product P, and a dispensing fitment 14 coupled to the container 12. The fitment 14 may be non-removably secured to the container 12. The terminology "non-removably secured" includes a manner in which the fitment 14 is, by design-intent, not intended to be removed from the container 12 without damaging the container and/or fitment 14 or otherwise visibly compromising the structural and/or functional integrity of either or both. Also, the fitment 14 may render the container 12 non-refillable. In other words, the fitment 14 may prevent or at least impede efforts to refill the container 12, for example, with counterfeit liquid products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both. As will be described below, the fitment 14 also may facilitate evidencing of efforts to tamper with the product 10, for example, via breakage of the container 12 when someone attempts to refill the container 12.

Figure 2:
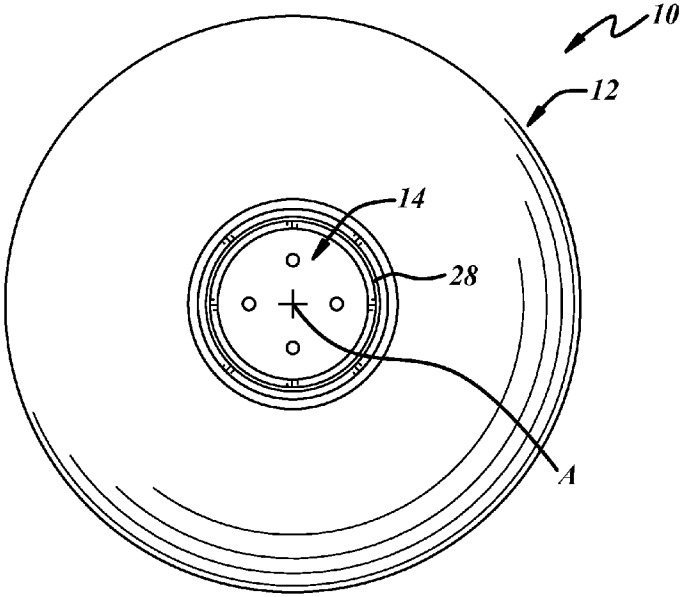
FIG. 2 is a top view of the product of FIG. 1.

The container 12 can be a bottle, for example, a wine or spirits bottle or any other suitable type of bottle or container, and can be composed of glass, ceramic, metal, plastic, or any other suitable material(s). The container 12 may include a bottom or base 18, a body 16 that may include a sidewall 20 extending in a directional axially away from the base 18 along a central longitudinal axis A of the container 12. The container 12 also may include a shoulder 22 extending in a directional axially away from the sidewall 20, and a neck 24 extending in a directional axially away from the shoulder 22 and including a neck finish 26. As used herein, directional words such as top, bottom, upper, lower, radial, circumferential, lateral, longitudinal, transverse, vertical, horizontal, and the like are employed by way of description and not limitation. The neck finish 26 may include an open end or mouth 28 of the container 12, and one or more closure engagement elements 30, for example, helical threads, or any other suitable feature(s), for coupling to a closure (not shown). The geometry of the container 12 of FIGS. 1 and 2 is illustrative only, and any other suitable geometries may be used.

Figure 3:
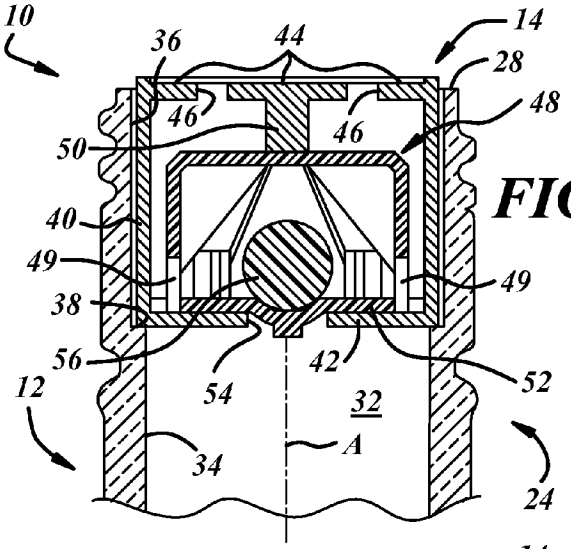
FIG. 3 is an enlarged, fragmentary, cross-sectional view of the product of FIG. 1, illustrating the fitment in a cold state relative to a warm state of the container.

With reference to FIG. 3, the container neck 24 may include an interior passage 32 to carry the fitment 14 and to communicate liquid out of the container body 16 (FIG. 1) and through and out of the neck 24. The passage 32 may include a through bore 34 and a counterbore 36 in which the fitment 14 may be positioned. The bores 34, 36 may be of cylindrical shape or of any other suitable geometry, and may be established by interior surfaces of the container neck 24. An internal shoulder or step 38 may be established between the bores 34, 36 and may serve as an axial locator for the fitment 14.

Various features of the fitment 14 illustrated in the drawing figures are illustrative only, and may be of any other suitable type or construction. The fitment 14 includes an axially extending circumferential outer wall 40 to contact the interior passage 32 of the container 12. The outer wall 40 may be a ring or ring-shaped, for example of oval or cylindrical shape, or of any other suitable shape corresponding to the shape of the corresponding portion of the container neck 24. The outer wall 40 may contact an axial stop portion of the container 12, for example, the step 38. The fitment 14 also may include a base wall 42 that extends transversely with respect to the outer wall 40. As used herein, the term transverse may mean disposed at some non-zero angle with respect to the longitudinal axis A of the container 12 and along any direction intersecting the container 12 and may include but is not limited to a radial direction.

The relationship between the fitment 14 and the container 12 may be such that an axial end of the fitment 14 extends axially out the mouth 28 of the container 12 axially beyond an axial end surface or lip of the container 12 to form an anti-drip edge or feature. For example, the fitment outer wall 40 may have an axial length such that it bottoms out at the internal shoulder 38 in the container 12 and extends out of the container mouth 28.

Figure 4:
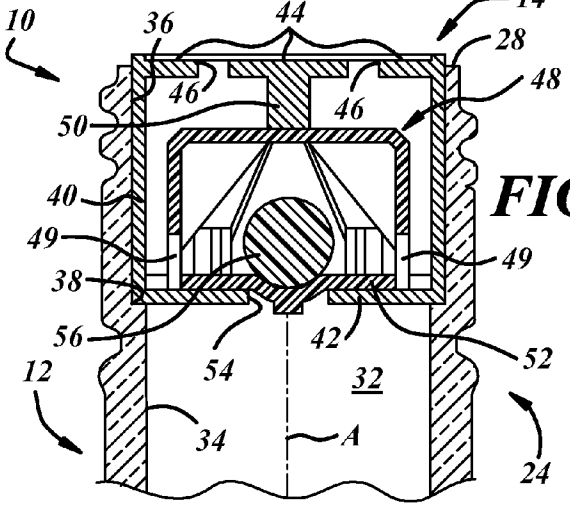
FIG. 4 is a view of the product similar to that of FIG. 4, except that a temperature of the fitment and the container are equalized, wherein the fitment is coupled to the container via an interference fit.

The fitment 14 further may include any suitable features to impede or prevent refilling of the container 12. For example, the fitment 14 may include a check valve that may be carried within the outer wall 40, for example, as illustrated in FIGS. 3 and 4. The check valve may include an outlet wall 44 having outlet apertures 46, and a cage 48 held between the base and outlet walls 42, 46 and spaced from the outlet wall 44 by a spacer 50 and having apertures 49. The outlet wall 44 may be recessed axially from the outer axial end of the outer wall 40 to provide anti-drip functionality. The check valve also may include a valve plate 52 axially movably retained by the cage 48 and covering an opening 54 in the base wall 44, and a valve ball 56 retained between the cage 48 and the valve plate 52. The aforementioned elements may be mounted within and to the outer wall 40 of the fitment 14 in any suitable manner. In one embodiment, the fitment 14 outer wall 40 may be composed of stainless steel or any other suitable metal, and one or more of the other portions of the fitment 14 may be composed of plastic, metal, or glass. In other embodiments, one or more portions of the fitment 14 may be composed of glass or ceramic. For example, the outer wall 40, axial wall 44, cage 48, and/or ball 56 may be composed of glass or ceramic. Accordingly, attempts to remove the fitment 14 may shatter the container 12 and/or the fitment 14.

The illustrative check valve permits flow of liquid out of the container body 16 (FIG. 1) but prevents or retards flow into the container body 16. For example, the valve ball 56 holds the valve plate 52 down to cover the base wall opening 54 to prevent flow therethrough. But when the container 12 is tipped or inverted, liquid may flow through the base wall opening 54 to displace the valve plate 52 and ball 56, and the liquid may flow out of the cage apertures 49 through the fitment 14 and out of the outlet openings 46. Non-refillable fitments are well known to those of ordinary skill in the art, and any suitable type of fitment may be used, whether a check valve type of fitment, an air trap type of fitment, or any other suitable type of refill-resistant fitment.

Figure 5:
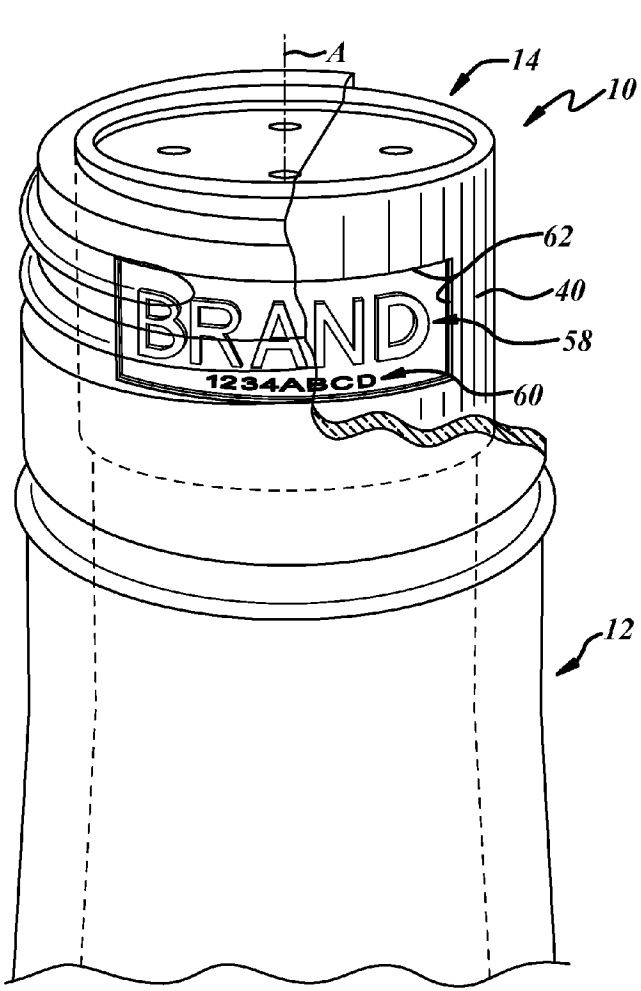
FIG. 5 is an enlarged, fragmentary, perspective view of the product of FIG. 1.

With reference to FIG. 5, the fitment 14 also may include decorative and/or informative features. For example, the outer wall 40 of the fitment 14 can carry indicia, for example, brand name indicia 58, package serial number indicia 60, a logo, a slogan, or the like. In another example, the features may include a radially recessed portion in the wall 40 that may extend axially and circumferentially, and may be rectangular in outer profile or of any other suitable shape. In one embodiment, the indicia may be disposed within the radially recessed portion and may project radially outwardly, as shown, or may be recessed, or printed, or the like. In another embodiment, the indicia may be carried on the fitment outer wall 40 and may be engraved or otherwise radially recessed in the outer wall 40, may be printed thereon, or the like. The various features may be formed, machined, lasered, etched, or produced in any other suitable manner. The features may be located on the fitment 14 in such a manner that the features are disposed completely within the container neck 24 below an axial end surface or lip of the container neck 24. Accordingly, the decorative and/or informative features are positioned on the inside of the container but are visible therethrough.

In production, a liquid product may be flowed into the container 12 in any suitable manner, and then the fitment 14 can be coupled into the neck 24 of the container 12 via an interference fit to render the product 10 tamper-evident. The fit between the outer wall 40 of the fitment 14 and the corresponding interior surface of the container 12 may be tight, wherein the fitment 14 cannot be removed without causing visible damage to the container 12. For example, the outer wall 40 of the fitment 14 may be larger than the corresponding interior surface of the container 12 that carries the fitment 14 when both the fitment 14 and the container 12 are at the same temperature.

In one embodiment, before assembly, the fitment 14 may be at a relatively cooler temperature than the container 12. In one example of this embodiment, before assembly, the fitment 14, or at least the outer wall 40 of the fitment 14, can be cooled to reduce the radially outer size of the outer wall 40 and the container 12, or at least the corresponding wall thereof, can be heated to increase its radially inner size. Then, the fitment 14 can be inserted into the container 12 to its desired axial position, and then as the fitment 14 warms up and the container 12 cools down, the radially outer size of the outer wall 40 expands into a tight fit with the corresponding contracting portion of the container 12.

In other embodiments, only the fitment 14 may be cooled, or only the container 12 may be warmed, and then the fitment 14 may be assembled to the container 12. Thereafter, expansion of the fitment 14 or contraction of the container 12 result in the interference fit.

In another embodiment, the fitment 14 may be press fit to the container 12. For example, the fitment 14 and the container 12 may be at the same or similar temperature, and the fitment 14 pressed into the container 12. Of course, care must be taken in the selection of the materials, wall thicknesses, and the like, to ensure that the hoop stresses are not so high that such press fitting breaks the container 12.

In a further embodiment, any combination of the aforementioned embodiments may be used.

It is believed that friction and/or surface tension between the fitment and the container resulting from the interference fit will sufficiently secure the fitment in place and render the fitment tamper-evident because attempts to remove the fitment should result in visible damage or breakage of the container and/or fitment. But other engagement features could be added such as barbs on the exterior of the fitment that could press into certain container materials, like plastic, and cause visible damage to the container if the fitment were removed or removal was attempted.

A method of inserting an anti-refill valve into the neck of a container may include the following steps: providing a container having a neck at a first temperature, mounting an anti-refill valve within a ring, providing the ring at a second temperature less than the first temperature, inserting the ring with anti-refill valve into the neck of the container, and allowing temperatures of the container neck and the ring to equalize to secure the ring and the valve within the neck. The ring may include the outer wall 40 of the fitment 14, and the anti-refill valve may include the various other elements of the fitment 14. Equalization of temperatures of the ring and/or container neck may occur passively over time, or may be actively accelerated by any suitable heating and/or cooling operation(s). Of course, artisans of ordinary skill will recognize that the relative cooling and warming temperatures are application specific, and dependent on material selection, wall thicknesses, diametric interference, and the like.

If, as they are known to do, counterfeiters attempt to melt a plastic portion of the fitment 14 by applying heat to the fitment 14, the outer wall 40 of the fitment 14 will expand and, thus, break the container neck 24, thereby facilitating evidence of tampering with the container 12 and likely rendering the container 12 unusable. The container 12 and/or fitment 14 would break because the portion of the fitment 14 expands to a greater extent than the container 12 for a given temperature and, thus, the expanding fitment 14 would stress the container 12 beyond its breaking point.

Figure 6:
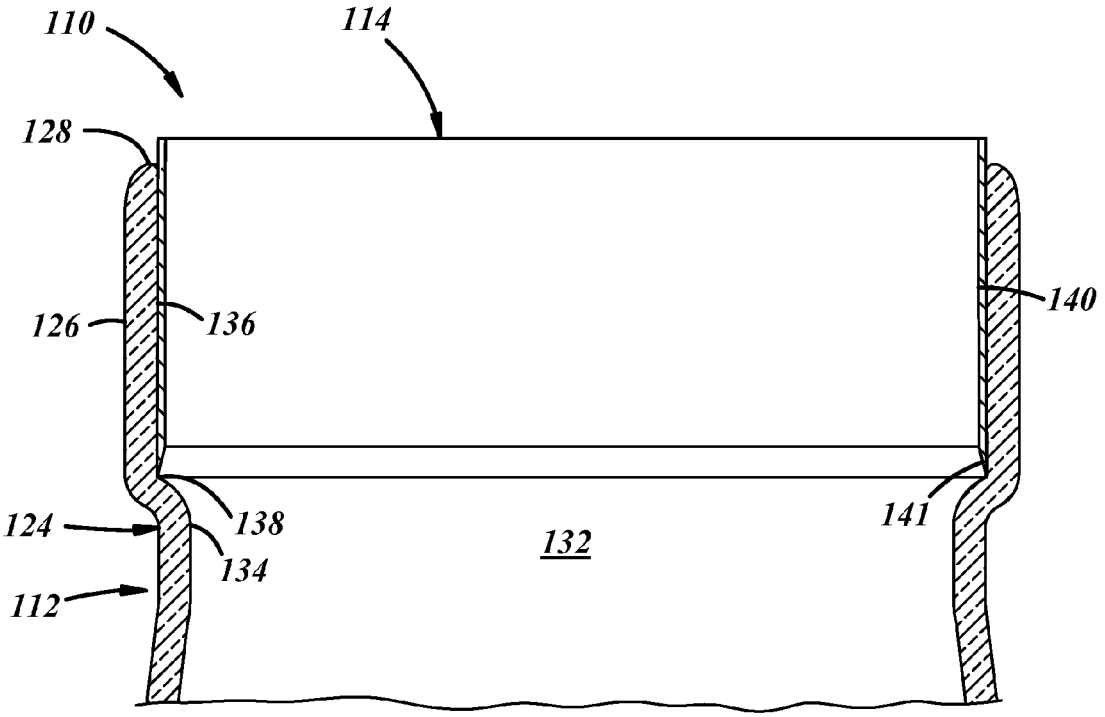
FIG. 6 is a fragmentary, cross-sectional view of a product in accordance with another illustrative embodiment of the present disclosure and including a container and a fitment coupled to the container.

FIG. 6 illustrates another illustrative embodiment of a product 110 including a container 112 and a fitment 114 non-removably coupled to the container 112. This embodiment is similar in many respects to the embodiment of FIGS. 1-5 and like numerals between the embodiments generally designate like or corresponding elements throughout the several views of the drawing figures. Accordingly, the descriptions of the embodiments are incorporated into one another. Additionally, the description of the common subject matter generally may not be repeated here.

In this embodiment, the container 112 includes a neck 124 including a neck finish 126. The neck finish 126 may include an open end or mouth 128 of the container 112. The container neck 124 may include an interior passage 132 to carry the fitment 114. The passage 132 may, but need not, take the form of a counterbore passage. For example, the passage 132 may include a through bore 134, a counterbore 136 in which the fitment 114 may be positioned, and an internal shoulder or step 138. The fitment 114 includes an axially extending radially outer wall 140 to contact the interior passage 132 of the container 112. The outer wall 140 may contact an axial stop portion of the container 112, for example, the step 138. The fitment 114 also may include a frusto-conical or tapered surface 141 between interior and exterior circumferential surfaces of the fitment 114 and at an interior end of the fitment 114. Accordingly, the tapered surface 141 may terminate in a relatively thin or sharp edge. The tapered surface 141 discourages attempts to remove the fitment 114 by hooking of the interior end of the fitment 114. The fitment 114 may be a simple annular component, as shown in FIG. 6, for example, to provide an anti-drip feature to the container 112. But the fitment 114 instead may include non-refillable features and functionality and, thus, may carry other components, for example, as shown in FIGS. 1-5.

Figure 7:
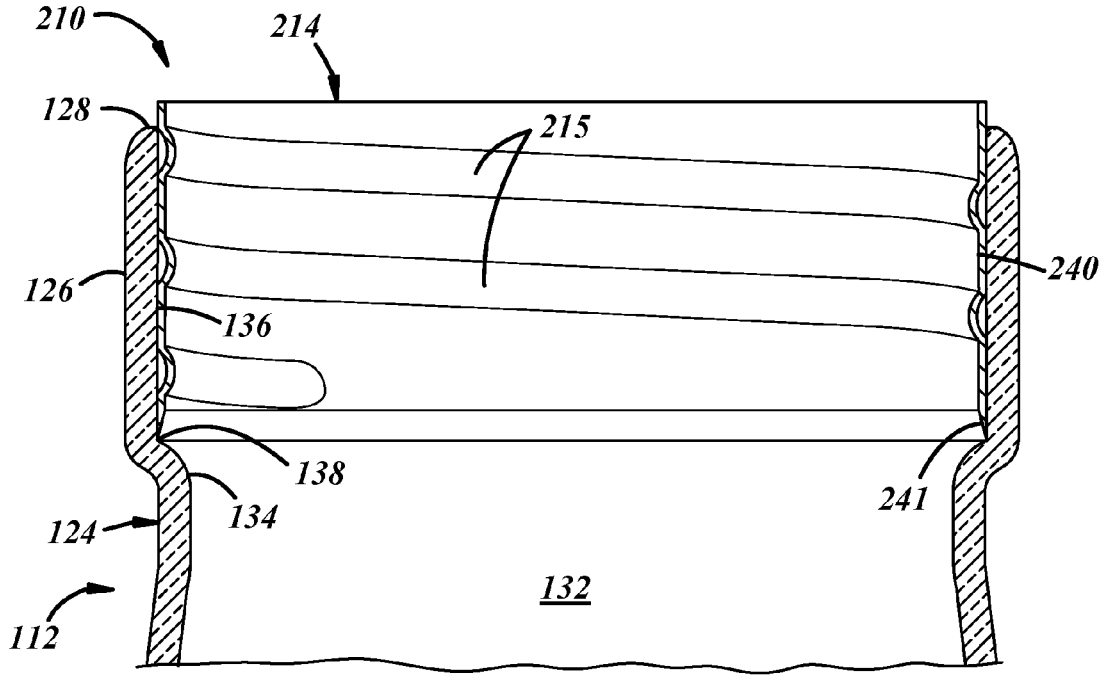
FIG. 7 is a fragmentary, cross-sectional view of a product in accordance with a further illustrative embodiment of the present disclosure and including a container and a fitment coupled to the container.

FIG. 7 illustrates another illustrative embodiment of a product 210 including the container 112 and a fitment 214 non-removably coupled to the container 112. This embodiment is similar in many respects to the embodiments of FIGS. 1-6 and like numerals between the embodiments generally designate like or corresponding elements throughout the several views of the drawing figures. Accordingly, the descriptions of the embodiments are incorporated into one another. Additionally, the description of the common subject matter generally may not be repeated here.

In this embodiment, the fitment 214 includes an axially extending circumferential outer wall 240 to contact the interior passage 132 of the container 112. The outer wall 240 may include a tapered surface 241 between interior and exterior circumferential surfaces of the fitment 214 and at an interior end of the fitment 214. The outer wall 240 of the fitment 214 also may include one or more engagement elements, for example, thread segments 215, for coupling other components or devices to the fitment, such as an aerator, an anti-refill device, or any other suitable products. As used herein, the term thread segment includes whole, partial, multiple, and/or an interrupted thread and/or thread segment. The fitment 214 may be a simple annular component, as shown in FIG. 7, for example, to provide a coupling and/or anti-drip feature to the container 112. But the fitment 214 instead may carry other components, for example, as shown in FIGS. 1-5.

There thus has been disclosed a container that is non-refillable and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A product that includes:

a glass container including a neck having an interior passage including a through bore, a counterbore, and an internal step between the throughbore and counterbore; and a fitment coupled to the neck of the container in the counterbore thereof via an interference fit between the container neck and a metal outer wall of the fitment, wherein the interference fit non-removably secures the fitment to the container to render the product tamper-evident, and wherein an interior axial end of the fitment is axially located against the internal step in the container and an outer axial end of the fitment extends axially out the container axially beyond a lip of the container to form an anti-drip feature, wherein the fitment includes an exterior circumferential surface, an interior circumferential surface, and a tapered surface between the circumferential surfaces at the interior end of the fitment to establish an edge that discourages attempts to remove the fitment from the container, wherein the fitment outer wall has an axial length such that it bottoms out at the internal step in the container and extends out of the container to the outer axial end.

2. The product set forth in claim 1, wherein the product is an anti-refill product, the fitment is an anti-refill dispensing fitment.

3. A product that includes:

a container including a neck; and a fitment coupled to the neck of the container via an interference fit, and including an exterior circumferential surface, an interior circumferential surface, and a tapered surface between the circumferential surfaces at an interior end of the fitment, wherein the neck includes an interior passage including a through bore and a counterbore in which the fitment is positioned, wherein the interior passage also includes an internal step between the through bore and the counterbore and against which the interior end of the fitment is axially located in the container, wherein the tapered surface of the fitment at the interior end thereof establishes an edge that discourages attempts to remove the fitment from the container, wherein the fitment has an outer wall with an axial length such that the outer wall bottoms out at the internal step in the container and extends out of the container to an outer axial end of the fitment.

4. The product set forth in claim 3, wherein the fitment extends axially out of the container to provide an anti-drip feature.

5. The product set forth in claim 3, wherein the fitment includes a base wall, an outlet wall axially spaced from the base wall, and a check valve carried within an outer wall of the fitment wherein the outlet wall is recessed axially from the outer axial end of the outer wall to provide the anti-drip feature.

6. The product set forth in claim 5, wherein the check valve includes an outlet wall having outlet apertures, a cage held between the base and outlet walls and spaced from the outlet wall by a spacer and having apertures, a valve plate axially movably retained by the cage and covering an opening in the base wall, and a valve ball retained between the cage and the valve plate.

7. The product set forth in claim 5, wherein at least a portion of the check valve is composed of plastic.

8. The product set forth in claim 3, wherein an outer wall of the fitment includes indicia.

9. The product set forth in claim 8, wherein the outer wall of the fitment includes a radially recessed portion including the indicia, which includes at least one of a brand name or a package serial number.

10. A product that includes:

a container including a neck having a cylindrical interior surface and an internal step; and a fitment coupled to the neck of the container via an interference fit, wherein the fitment includes an outer wall of the fitment having an exterior circumferential surface, an interior circumferential surface, and a tapered surface between the circumferential surfaces at an interior end of the fitment to establish an edge located against the internal step of the container neck that discourages attempts to remove the fitment from the container, wherein the outer wall has an axial length such that the outer wall bottoms out at the internal step in the container and extends out of the container to an outer axial end of the fitment.

11. A product that includes:

a container including a neck; and a fitment coupled to the neck of the container via an interference fit, wherein the fitment includes an outer wall of the fitment having an exterior circumferential surface, an interior circumferential surface, and a tapered surface between the circumferential surfaces at an interior end of the fitment wherein the tapered surface establishes an edge that discourages attempts to remove the fitment from the container and wherein the fitment includes the outer wall carrying thread segments protruding radially inwardly for coupling other components to the fitment, wherein the fitment outer wall has an axial length such that the outer wall bottoms out at the internal step in the container and extends out of the container to an outer axial end of the fitment.

12. A product comprising a container with an inside, a fitment interference fit inside the container, wherein the fitment includes an outer wall and indicia carried by the outer wall so that the indicia are positioned on the inside of the container but are visible therethrough, and wherein the indicia is recessed in the outer wall of the fitment, wherein the outer wall of the fitment includes a radially recessed portion that extends axially and circumferentially, and wherein the indicia is positioned within the radially recessed portion.

13. The fitment set forth in claim 12, wherein the indicia includes at least one of a brand name or a package serial number.

* * * * *